US008457512B2

(12) United States Patent
Seol et al.

(10) Patent No.: US 8,457,512 B2
(45) Date of Patent: Jun. 4, 2013

(54) FUSING UNIT, CONTROL METHOD THEREOF AND IMAGE FORMING APPARATUS EMPLOYING THE SAME

(75) Inventors: Dong-Jin Seol, Suwon-Si (KR); Jae-Hyuk Lim, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 625 days.

(21) Appl. No.: 12/564,399

(22) Filed: Sep. 22, 2009

(65) Prior Publication Data

US 2010/0119247 A1 May 13, 2010

(30) Foreign Application Priority Data

Nov. 12, 2008 (KR) ..... 10-2008-0112174

(51) Int. Cl.
*G03G 15/16* (2006.01)
*G03G 15/20* (2006.01)
*G03G 15/00* (2006.01)

(52) U.S. Cl.
USPC ..... 399/67; 399/122; 399/126; 399/328

(58) Field of Classification Search
USPC ..... 399/67, 122, 126
See application file for complete search history.

(56) References Cited

U.S. PATENT DOCUMENTS 4,972,232 A * 11/1990 Hoover et al. ..... 399/122
5,831,744 A * 11/1998 Kataoka ..... 358/296
5,956,553 A * 9/1999 Park ..... 399/307
6,308,021 B1 * 10/2001 Isogai et al. ..... 399/67
6,347,201 B1 * 2/2002 Sano et al. ..... 399/67
6,697,579 B2 * 2/2004 Ito et al. ..... 399/13
7,050,747 B2 * 5/2006 Fuma et al. ..... 399/328
7,620,336 B2 * 11/2009 Yura et al. ..... 399/67
2005/0214002 A1 * 9/2005 Baruch et al. ..... 399/45
2005/0214003 A1 * 9/2005 Baruch et al. ..... 399/45
2005/0214008 A1 * 9/2005 Baruch et al. ..... 399/67
2005/0214009 A1 * 9/2005 Baruch et al. ..... 399/67
2005/0220473 A1 * 10/2005 Bott et al. ..... 399/67
2006/0239703 A1 * 10/2006 Kwon et al. ..... 399/45
2007/0019978 A1 * 1/2007 Kim ..... 399/67
2007/0258724 A1 * 11/2007 Baruch et al. ..... 399/67
2008/0031647 A1 * 2/2008 Yoshikawa ..... 399/67
2008/0181645 A1 * 7/2008 Nakamura ..... 399/70

(Continued)

FOREIGN PATENT DOCUMENTS

JP 2007-025571 2/2007
JP 2008-165091 7/2008

OTHER PUBLICATIONS

English language abstract of JP 2007-025571, published Feb. 1, 2007.

(Continued)

*Primary Examiner* — Walter L Lindsay, Jr.
*Assistant Examiner* — David Bolduc
(74) *Attorney, Agent, or Firm* — Stanzione & Kim, LLP

(57) ABSTRACT

Disclosed are a fusing unit capable of a variable fusing pressing force, a control method thereof and an image forming apparatus employing the same. The fusing pressing force may be selectively varied so as to apply a lesser force at the initial stage of the operation of the fusing unit, and may be increased to a desired level of force suitable for fusing operation so as to minimize excessive torque in a driving motor that rotationally drives the fusing device.

18 Claims, 12 Drawing Sheets

U.S. PATENT DOCUMENTS

| | | | | |
|---|---|---|---|---|
| 2008/0181686 | A1* | 7/2008 | Geyling et al. | 399/329 |
| 2008/0199231 | A1* | 8/2008 | Lee et al. | 399/329 |
| 2008/0226363 | A1* | 9/2008 | Tateishi et al. | 399/327 |
| 2008/0260405 | A1* | 10/2008 | Carolan et al. | 399/67 |
| 2008/0310895 | A1* | 12/2008 | Masuda et al. | 399/331 |

OTHER PUBLICATIONS

Machine English language translation of JP 2007-025571, published Feb. 1, 2007.

English language abstract of JP 2008-165091, published Jul. 17, 2008.

Machine English language translation of JP 2008-165091, published Jul. 17, 2008.

Korean Office Action dated Mar. 15, 2013 issued in KR Application No. 10-2008-0112174.

* cited by examiner

FUSING UNIT, CONTROL METHOD THEREOF AND IMAGE FORMING APPARATUS EMPLOYING THE SAME

CROSS-REFERENCE TO RELATED APPLICATION

This application claims priority from Korean Patent Application No. 10-2008-0112174, filed on Nov. 12, 2008 in the Korean Intellectual Property Office, the disclosure of which is incorporated herein by reference.

TECHNICAL FIELD

Apparatuses and methods consistent with the present disclosure relate generally to a fusing unit of an image forming apparatus, and more particularly to a fusing unit capable of controlling the fusing pressure, a control method thereof and an image forming apparatus employing the same.

BACKGROUND OF RELATED ART

In general, an electrophotographic image forming apparatus scans light onto an image receptor charged with a predetermined electric potential to form an electrostatic latent image, develops the electrostatic latent image into a toner image, and then transfers and fuses the toner image on a printing medium, so as to print an image. The fusing unit is arranged on a printing medium path in the image forming apparatus to fuse the transferred image on the printing medium.

For example referring to FIG. 1, a conventional fusing unit may include a heating roller 5 in which a source of heat, e.g., a heat lamp 3, is installed and a pressing roller 7 which is elastically biased towards the heating roller 5 so as to oppose and is the heating roller 5 to form a fusing nip therewith. As a printing medium 1 on which a toner image 1*a* passes through the fusing nip formed between the heating roller 5 and the pressing roller 7, the toner image 1*a* is adhered to the printing medium 1 by heat and pressure, thereby completing the fusing process.

In a fusing unit of the above-described configuration, the time required for the warming up can be relatively long because of the large heat capacity of the heating roller 5, resulting in a relatively long time for completing and outputting the first printed image.

Referring to FIG. 2, another example of a conventional fusing unit may include a heating film or belt 11 inside which a heat source 13 is installed; a nip plate 15 and a pressing roller 17. The nip plate 15 rotatably supports the heating film 11, and opposes the pressing roller 17 with the heating film 11 being interposed therebetween. The pressing roller 17 may be elastically biased towards the heat film 11 by an elastic member 19. With such configuration shown in FIG. 2, a relatively shorter warm up time, and thus a shorter time taken to output the first printed image, may be possible when compared with the conventional fusing unit shown in FIG. 1.

To operate conventional fusing units of the configurations shown in FIGS. 1 and 2 initially from resting state or during a printing medium jam state, the driving motor (not shown) rotationally driving the fusing unit may be subject to an increased level of torque.

As an illustration, plotted in FIG. 3 is the change in the torque and the rotational speed over time starting from the initial driving stage of the driving motor of a fusing unit that is, for example, configured as shown in FIG. 1.

Referring to FIG. 3, the driving torque of the driving motor in the initial driving stage of the fusing unit is about 16 kgf·cm, which is about 3 times of the driving torque once the fusing unit reaches a operational state, which is about 5 kgf·cm. It can also be observed, in this example, that the stable driving state is reached after the elapse of about 30 seconds. The rotational speed remains substantially constant at about 140 rpm. Similar torque change can be observed with respect to a fusing unit of the configuration illustrated in FIG. 2.

The increased level of torque during the initial driving stage or in the printing medium jam state as described above in conventional fusing units, such as, for example, those shown in FIGS. 1 and 2 may overload to the driving motor, and may thus adversely impact the useful operational life of the motor.

SUMMARY OF THE DISCLOSURE

According to an aspect of the present disclosure, a fusing unit may be provided to include a fusing device, a pressing force adjuster and a controller. The fusing device may be configured to apply heat and pressure so as to fix an image on a printing medium, and may include a rotational member configured to be rotationally driven by a driving motor. The pressing force adjuster may be configured to vary a pressing force applied by the fusing device. The controller may be configured to control the pressing force adjuster so as to selectively adjust the pressing force applied by the fusing device in consideration of a driving torque of the driving motor.

The controller may be configured to control the pressing force adjuster so that a first pressing force is applied by the fusing device during an initial driving stage of the fusing device. The first pressing force may be smaller than a second pressing force that is applied by the fusing device during a normal driving stage of the fusing device.

The controller may be configured to control the pressing force adjuster so that the pressing force applied by the fusing device continuously increases from the first pressing force to the second pressing force over a duration of time.

The controller may be configured to control the pressing force adjuster so that the rate of increase in the pressing force varies during the duration of time.

The duration of time may be divisible into first, second and third sequential time periods of substantially equal duration. The rate of increase in the pressing force may be greater during the second sequential time period than that during each of the first and third sequential time periods.

The pressing force adjuster may comprise a variable motor controlled by the controller, a gear lever configured to be rotationally driven by the variable motor, a first lever member configured to rotate about a first hinge in engagement with the gear lever, a second lever member configured to rotate about a second hinge, and to press against a portion of the fusing device and an elastic member disposed between the first lever member and the second lever member, the elastic member being configured to vary an elastic force applied to the second lever member according to a rotational position of the first lever member.

Alternatively, the controller may be configured to control the pressing force adjuster so that the pressing force applied by the fusing device increases from the first pressing force to the second pressing force in a plurality of stages over a duration of time. The pressing force adjuster may comprise a variable motor under control of the controller, a cam member configured to be rotated by the variable motor and having a cam profile that includes at least two different radii, a lever member configured to pivot about a hinge and supporting a portion of the fusing device and an elastic member configured to elastically bias the lever member towards the cam member.

According to an embodiment, the cam profile of the cam member may comprise at least three different radii, each of which respectively corresponding to a first operational stage, a second operational stage and a third operational stage of the fusing device. The fusing device may be configured to apply the first pressing force in the first operational stage, a third pressing force in the second operational stage and the second pressing force in the third operational stage. The third pressing force may be greater than the first pressing force and smaller than the second pressing force. The controller may be configured to control the pressing force adjuster so that the second operational stage occurs between the first and the third operational stages.

The controller may be configured to control the pressing force adjuster so that the second operational stage lasts for a first time duration that is shorter than a second time duration during which the fusing device is in the first operational stage.

According to an embodiment, the fusing device may comprise a belt member configured to rotate so as to define a loop, a heat source disposed inside the loop, a nip plate disposed inside the loop and in pressing contact with a portion of the belt member and a pressing roller arranged outside the loop in pressing contact with the belt member so as to oppose the nip plate with the belt member being interposed therebetween to thereby form a contact nip between the belt member and the pressing roller.

According to another aspect, a method of controlling a fusing unit configured to apply heat and pressing force to fix an image onto a printing medium may be provided to include the steps of: applying a first pressing force in the fusing unit at a first time; operating a driving motor to rotate at least a portion of the fusing unit; and adjusting the pressing force such that a second pressing force greater than the first pressing force is applied in the fusing unit at a second time later in time than the first time.

The step of adjusting the pressing force may comprise continuously increasing the pressing force from the first pressing force to the second pressing force. The rate of increase in the pressing force may be variable during a duration of time between the first and second times.

The duration of time may be divisible into first, second and third sequential time periods of substantially equal duration. The rate of increase in the pressing force may be greater during the second sequential time period than that during each of the first and third sequential time periods.

The step of adjusting the pressing force may comprise increasing the pressing force in stages that includes a stage in which a third pressing force that is greater than the first pressing force and that is smaller than the second pressing force is applied for a predetermined period of time between stages of application of the first pressing force and the second pressing force.

The predetermined time during which the third pressing force is applied may he shorter than a time duration during which the first pressing force is applied.

According to yet another aspect, an image forming apparatus may be provided to include an image receptor, a light exposure unit, a developing unit, a transfer unit, a controller and a fusing unit. The light exposure unit may be configured to expose the image receptor to thereby form thereon an electrostatic latent image. The developing unit may be configured to develop the electrostatic latent image to thereby form a toner image on the image receptor. The transfer unit may be configured to cause the toner image formed on the image receptor to be transferred onto a printing medium. The fusing unit may be configured to fix the transferred toner image on the printing medium, and may comprise a fusing device and a pressing force adjuster. The fusing device may be configured to apply heat and pressing force to the printing medium so as to fix the toner image on the printing medium. The fusing device may include a rotational member configured to be rotationally driven by a driving motor. The pressing force adjuster may be configured to vary the pressing force applied by the fusing device. The controller may be configured to control the pressing force adjuster so as to selectively adjust the pressing force applied by the fusing device in consideration of a driving torque of the driving motor.

According to an even yet another aspect, a fusing unit may be usable in an image forming apparatus for fixing an image on a printing medium by applying heat and pressing force, and may be provided to include a heating member, a pressing member and a pressing force adjustment mechanism. The heating member may have a source of heat. The pressing member may be in pressing contact with the heating member so as to apply the pressing force on the heating member. The pressing force adjustment mechanism may be configured to selectively vary the pressing force applied by the pressing member such that a first pressing force is applied at a first instance of time, and such that a second pressing force different from the first pressing force is applied at a second instance of time that is later in time than the first instance of time.

The first pressing force may be smaller than the second pressing force. The pressing force adjustment mechanism may further be configured to cause the pressing force to increase from the first pressing force to the second pressing force over a duration of time between the first instance of time and the second instance of time.

The fusing unit may further comprise a motor configured to rotationally drive the pressing member. The torque generated by the motor may remain substantially constant during the duration of time between the first instance of time and the second instance of time.

BRIEF DESCRIPTION OF THE DRAWINGS

Various features and advantages of the present disclosure will become more apparent by the following detailed description of several embodiments thereof with reference to the attached drawings, of which.

DETAILED DESCRIPTION OF SEVERAL EMBODIMENTS

Figure 1:
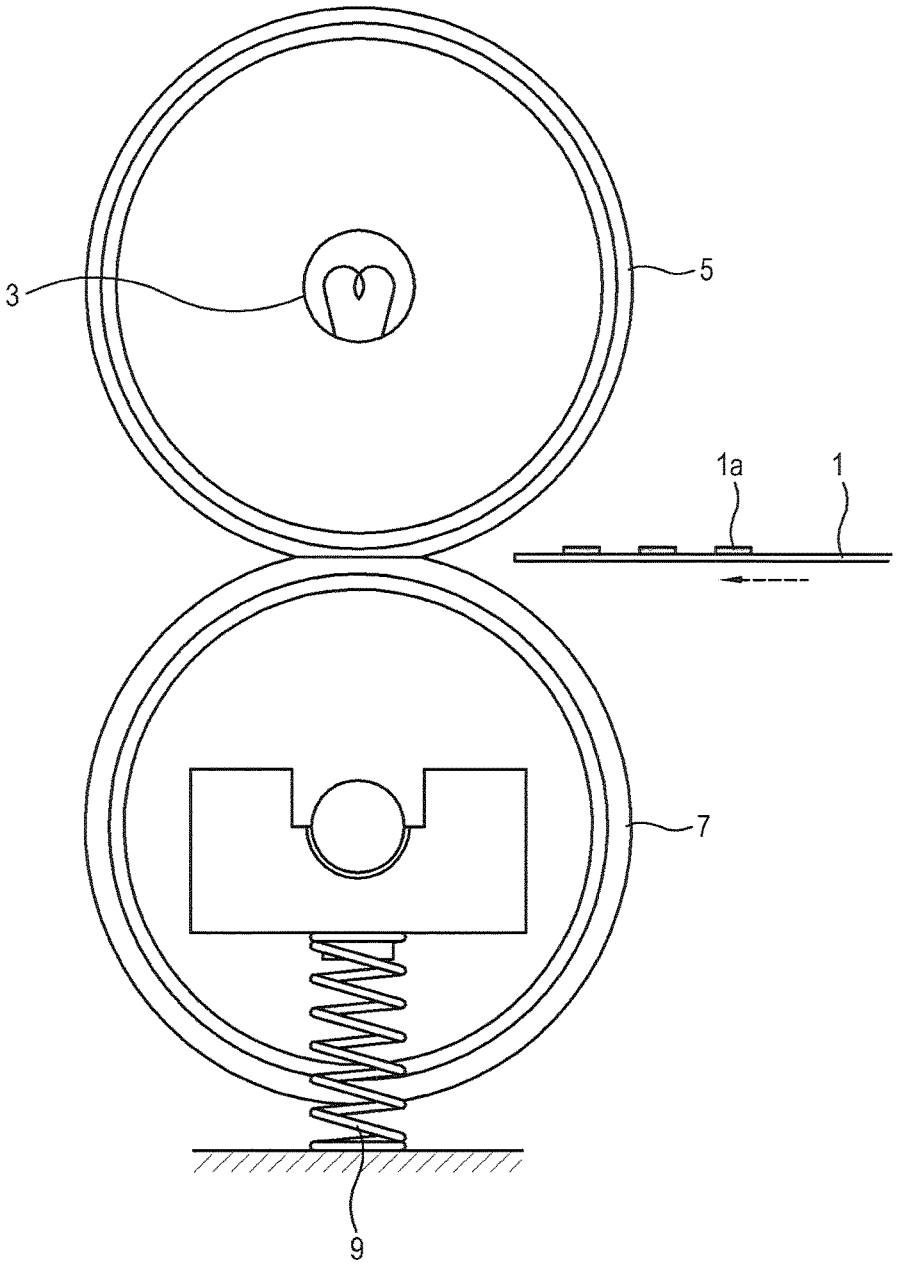
FIG. 1 is a schematic sectional view of an example of a conventional fusing unit.
Figure 2:
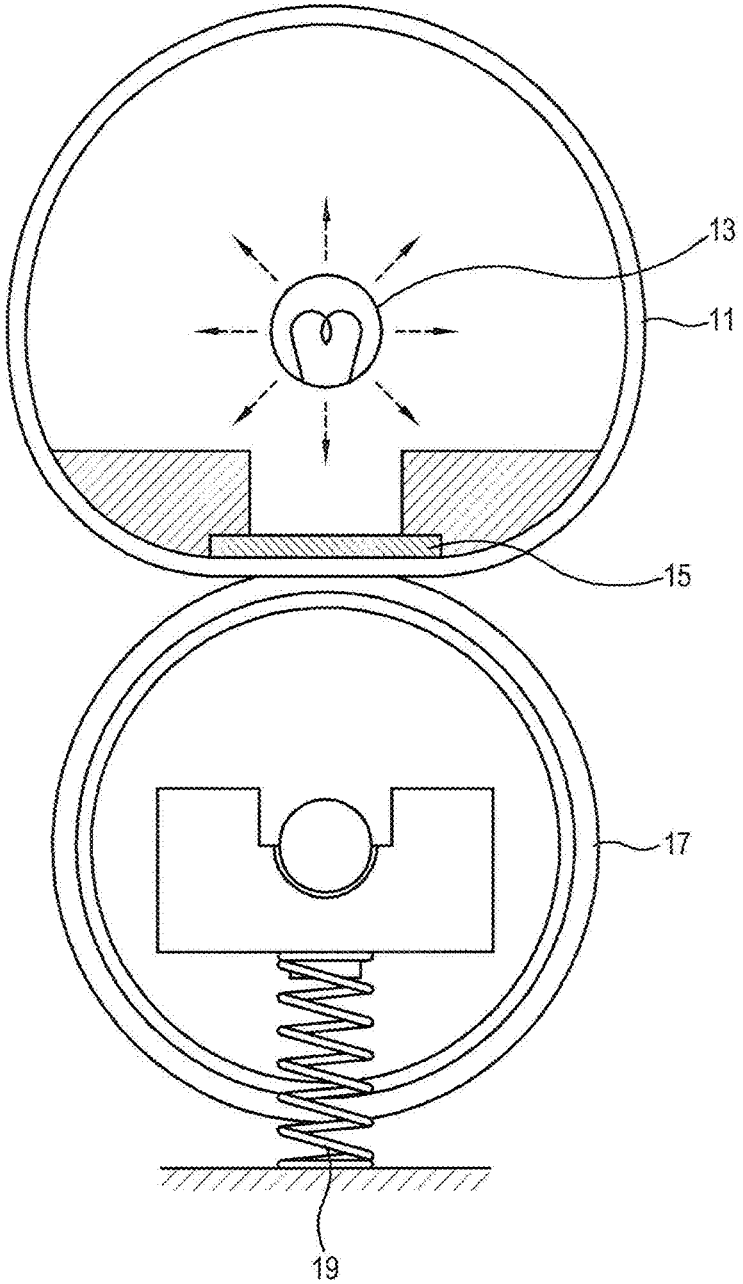
FIG. 2 is a schematic sectional view of an another example of a conventional fusing unit.

Reference will now be made in detail to several embodiment, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not he described in detail so as to avoid obscuring the description with unnecessary detail. It should also be noted that in the drawings, the dimensions of the features are not intended to be to true scale and may be exaggerated for the sake of allowing greater understanding. Repetitive description with respect to like elements of different embodiments may be omitted for the sake of brevity.

Figure 4:
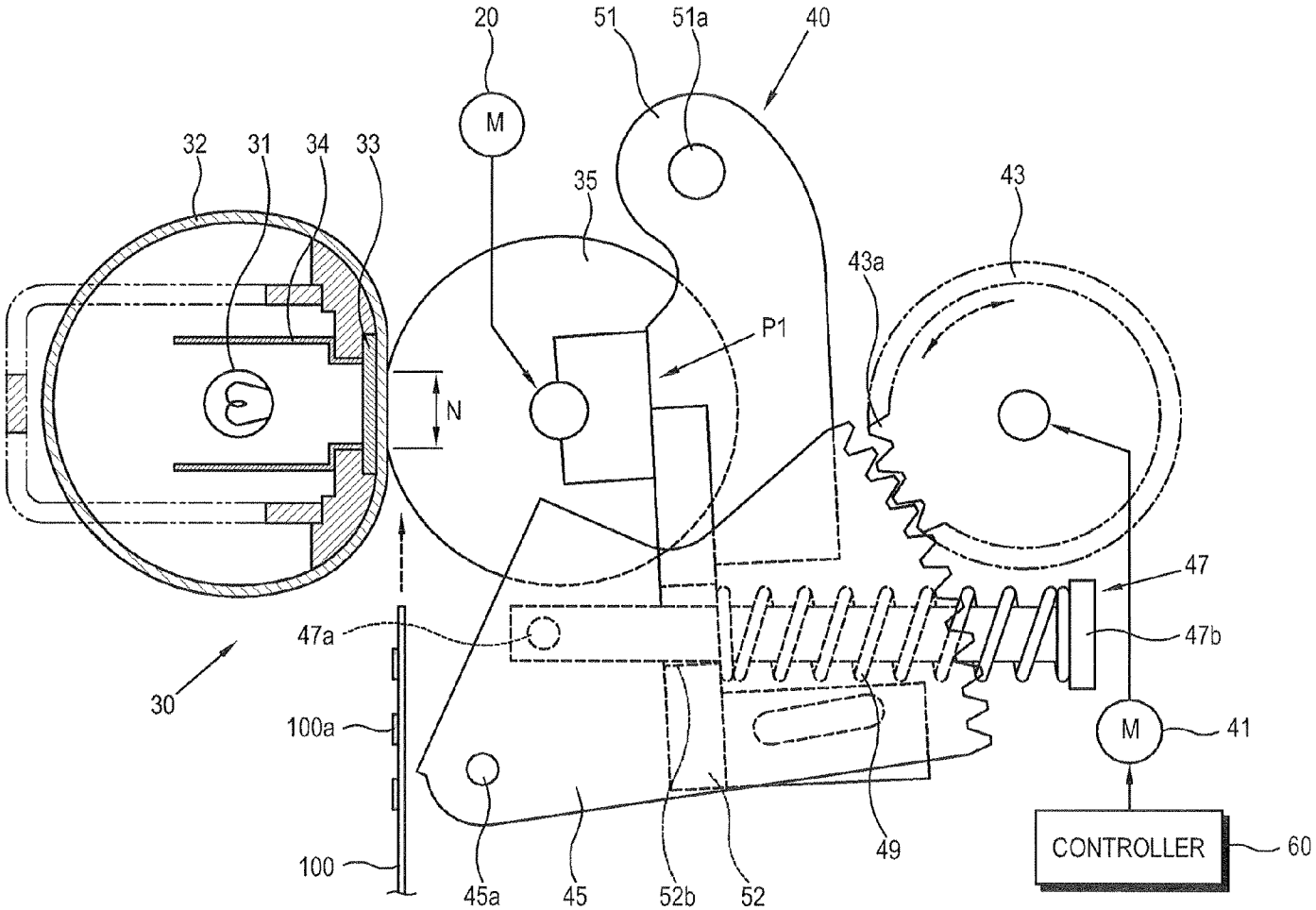
FIGS. 4 to 6 are schematic sectional views illustrating a fusing unit according to an embodiment of the present disclosure in operational states, in which a first pressing force P1, a third pressing force P3 and a second pressing force P2 are respectively applied.
Figure 5:
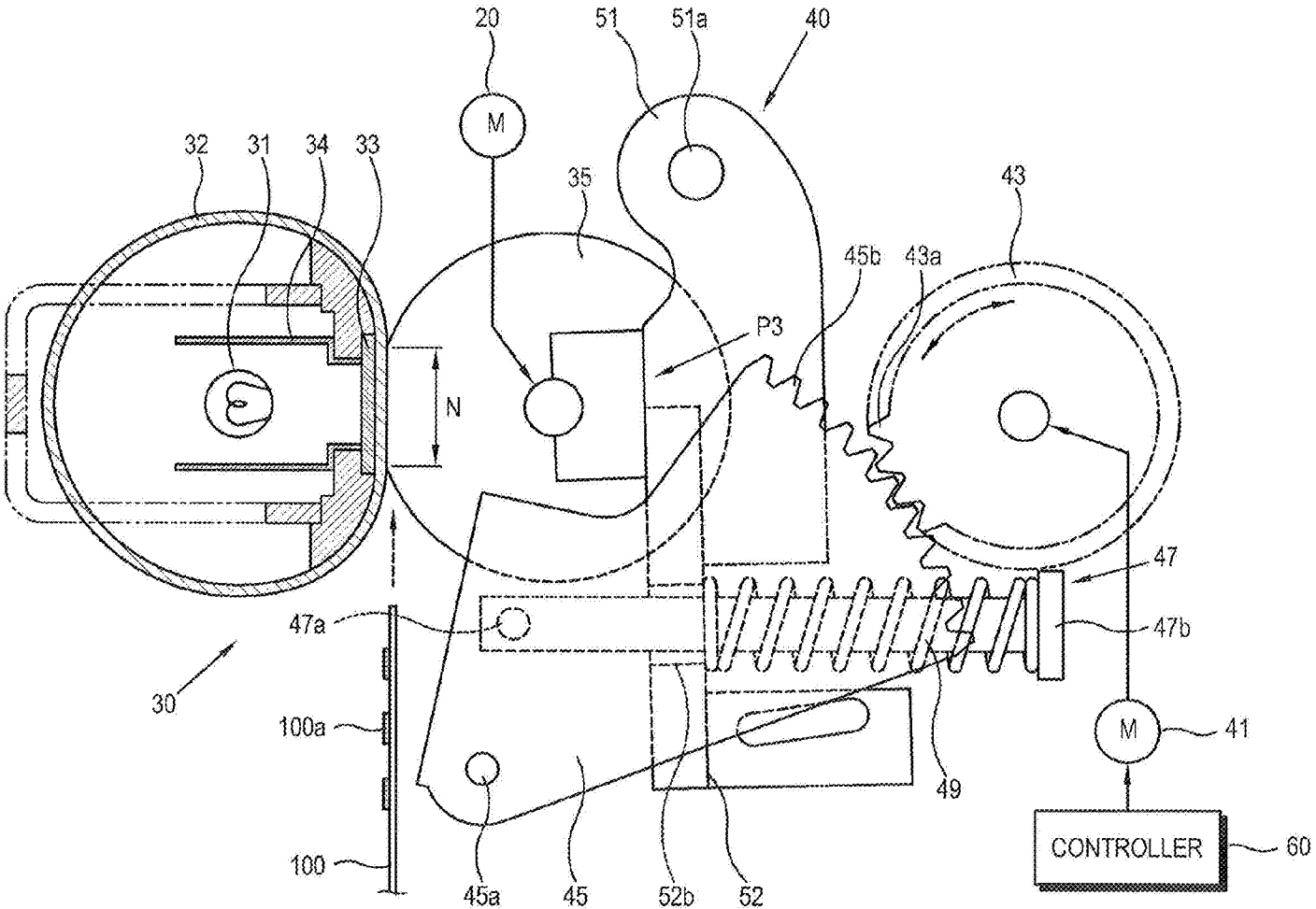
Figure 6:
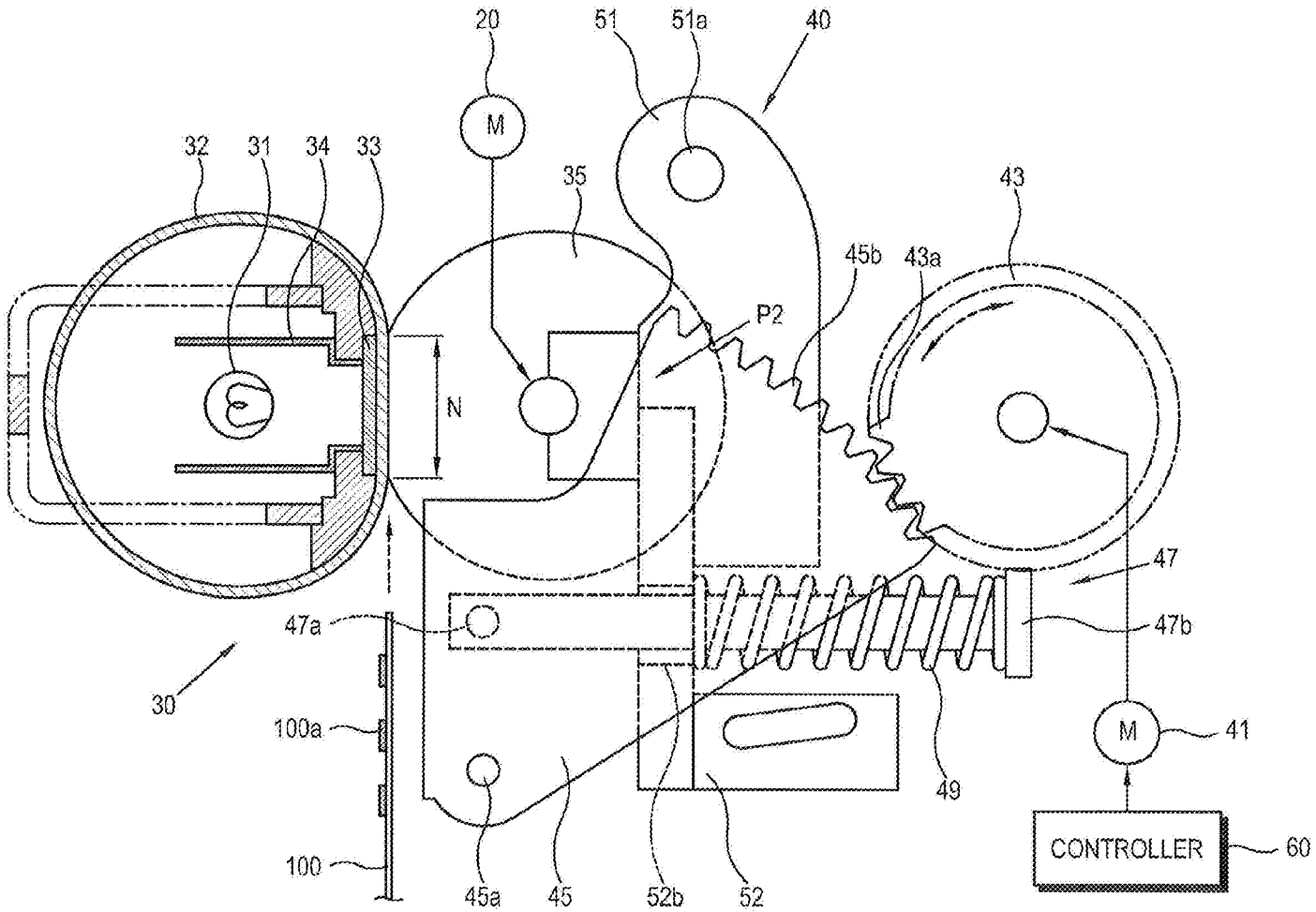

FIGS. 4 to 6 are schematic sectional views illustrating a fusing unit according to an embodiment of the present disclosure in various operational state, in which a first pressing force P1, a third pressing force P3 and a second pressing force P2 are respectively applied.

Referring to FIGS. 4 to 6, the fusing unit according to the embodiment may include a driving motor 20, a fusing part 30, a pressing force adjuster 40 and a controller 60.

The fusing part 30 may be rotated by the driving motor 20, and may heat and press a printing medium 100 to fuse a toner image 100*a* to the printing medium 100.

To this end, the fusing part 30 may include a heat source 31, a belt member 32, a nip plate 33 and a pressing roller 35.

The heat source 31 emits radiant heat for heating the belt member 32 and the nip plate 33. The heat source 31 may include, for example, a halogen lamp, a resistive heating element, or the like, provided in the belt member 32. The nip plate 33 is heated by the heat source 31, and may thereby heat, and press against, the printing medium 100 passing through a fusing nip N formed between the belt member 32 and the pressing roller 35 to thereby perform the fusing operation.

The fusing part 30 may further include a reflecting member 34, which may be disposed on each sides of the heat source 31, and which may reflect the heat generated by the heat source 31 towards the nip plate 33 so that the heat from the heat source 31 may be focused at the fusing nip N. To that end, the reflecting member 34 may be formed of a metal such as, for example, stainless steel, aluminum, copper (or an alloy thereof), or ceramics and/or fiber reinforced metal (FRM), or the like.

The belt member 32 may be arranged to rotate around the heat source 31, the nip plate 33 and the reflecting member 34, and may guide the printing medium 100 in cooperation with the pressing roller 35 in such manner to avoid damaging the toner image 100*a* formed on the printing medium 100 during the fusing process.

The pressing roller 35 may be arranged to oppose the nip plate 33 with the belt member 32 being disposed therebetween. The pressing roller 35 may rotate the belt member 32, and may form the fusing nip N between the pressing roller 35 and the nip plate 33 by being pressed against each other by the force applied from the pressing force adjuster 40. While an embodiment utilizing a belt, such as the belt member 32 is described as an illustrative example, it should be noted that the present disclosure is not so limited, and that, for example, in a different configuration, a roller may be employed in lieu of the belt.

The pressing force adjuster 40 may be configured to continuously adjust the pressing force applied to the fusing part 30. For this purpose, the pressing force adjuster 40 according to an embodiment may include a variable motor 41, a gear lever 43, a first lever member 45, a second lever member 51 and an elastic member 47.

The variable motor 41 may provide a driving force with varying pressing force under the control of the controller 60. The variable motor 41 may be, for example, a stepping motor. According to an embodiment, the pressing force adjuster 40 may also include a groove sensor (not shown) that detects the position of a groove provided in the pressing force adjuster 40, based on which detection, the controller 60 may control the number of steps by which the variable motor 41 turns to adjust the pressing force with an improved accuracy.

The gear lever 43 may be rotated by the variable motor 41. The gear lever 43 may have first gear teeth 43*a* formed on at least a portion of the circumference thereof.

The first lever member 45 may be arranged to rotate or pivot about a first hinge 45*a*, and may have formed at one end thereof remote from the first hinge 45*a* a second gear teeth 45*b* which is configured to engage with the first gear teeth 43*a* so that the first lever member 45 may rotate about the first hinge 45*a* in cooperation with the gear lever 43.

The second lever member 51 may be arranged to rotate about a second hinge 51*a*, and to exert a pressing force on the pressing roller 35 of the fusing part 30. The second lever member 51 may include a supporting portion 52 that is configured to receive an elastic force from an elastic member, which according to an embodiment, may include a compression guide bar 47 and a compression spring 49.

The elastic member may be disposed between the first lever member 45 and the second lever member 51, and may be configured to apply a variable elastic force on the second lever member 51 according to the rotational position of the first lever member 45. An end portion of the compression guide bar 47 may be hingedly coupled to the first lever member 45 so as to be capable of pivoting about a third hinge 47*a*. The supporting part 52 may include a through hole 52*b* into which the compression guide bar 47 can be slidably received. The compression guide bar 47 may include a head 47*b*, which supports one end of the compression spring 49 disposed around the compression guide bar 47. The other end of the compression spring 49 may be supported by the supporting part 52. With such configuration, the elastic force of the compression spring 49 may be varied depending on the rotational position of the first lever member 45 while the rotational position of the second lever member 51 may in turn be determined by the amount of the elastic force of the compression spring 49.

The pressing force of the fusing part 30 may be adjusted using the pressing force adjuster 40 as above described, and can be maintained by the power being applied to the variable motor 41. That is, when power is applied to the variable motor 41 so that the rotational force that balances the elastic force of the compression spring 49 is applied to the gear lever 43, the elastic force of the compression spring 49 and the rotational force of the gear lever 43 balance each other, thereby maintaining the level of the pressing force applied to the fusing part 30. Further, in an abnormal power-off state, such as, for example when a power failure occurs, the pressing force exerted against the fusing part 30 may be released, which in tern makes it easier to address a printing medium jam that may have occurred.

Figure 3:
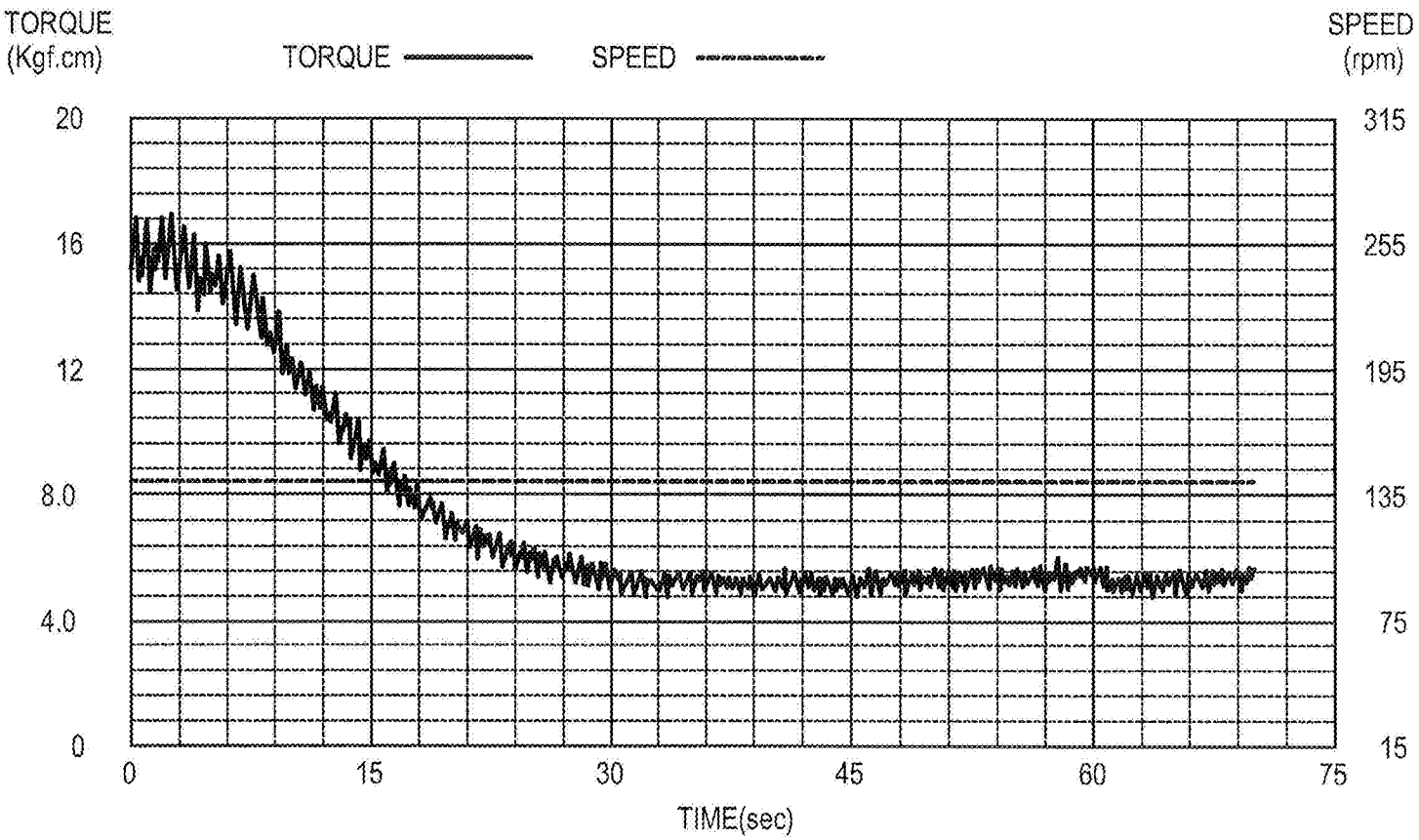
FIG. 3 is a graph illustrating the change over time of the torque and the rotational speed during an initial driving stage of the driving motor of a fusing unit configured as shown in FIG. 1.

The controller 60 may be configured to control the pressing force adjuster 40 so that the pressing force applied to the fusing part 40 can vary depending on the driving torque of the driving motor 20. According to an embodiment, the controller 60 may control the pressing force adjuster 40 so that the pressing force can vary between a first pressing force P1 and a second pressing force P2. With respect to the embodiment, the first pressing force P1 may refer to the pressing force applied to the fusing part 30 during the initial driving stage of the fusing part 30. The initial driving stage refers to a driving stage during which an initial warming up of the fusing part 30 is performed, such as, for example, upon receipt of a first printing command after powering up the image forming apparatus. The second pressing force P2 may refer to the pressing force applied during a normal driving state, during which the driving torque of the driving motor 20 is stabilized. For example, in the example shown in FIG. 3, the normal driving state is reached a predetermined time (for example, 30 seconds) after the driving of the fusing unit is initiated. According to an embodiment, as shown in FIG. 5, a third pressing force P3 may he applied to the fusing part 30, where the third pressing force P3 is greater than the first pressing force P1, and is less than the second pressing force P2.

The controller 60 controls the pressing force adjuster 40 so that the pressing force applied to the fusing part 30 increases from the first pressing force P1 to the second pressing force P2 over a duration of time. According to an embodiment, as shown in FIG. 7, the controller 60 may be configured to control the pressing force adjuster 40 so that the rate of increase of the pressing force may be different in various time segments.

Figure 7:
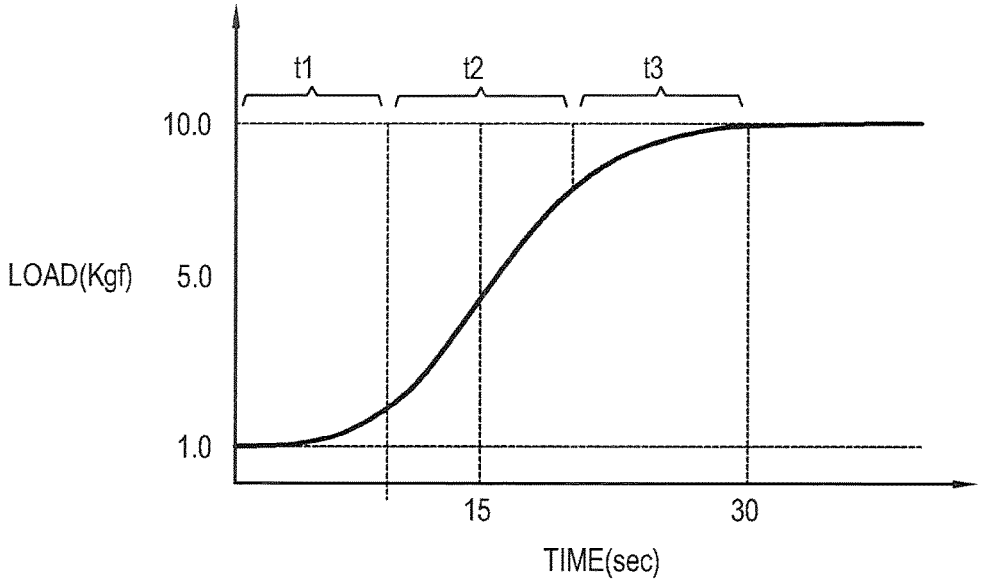
FIG. 7 is a graph illustrating the change over time in the pressing force of a fusing unit according to an exemplary embodiment of the present disclosure.

FIG. 7 illustrates the change in the pressing force over time. Referring to FIG. 7, if the total duration of time required to increase the pressing force from the first pressing force (P1: 1.0 kgf) to the second pressing force (P2: 10.0 kgf) is divided into three equal segments, the first through third time periods t1, t2 and t3, the controller 60 may be configured to control the pressing force adjuster 40 so that the rate of increase in the pressing force in the second time period t2 is greater than those in the first and third time periods t1 and t3.

Figure 8:
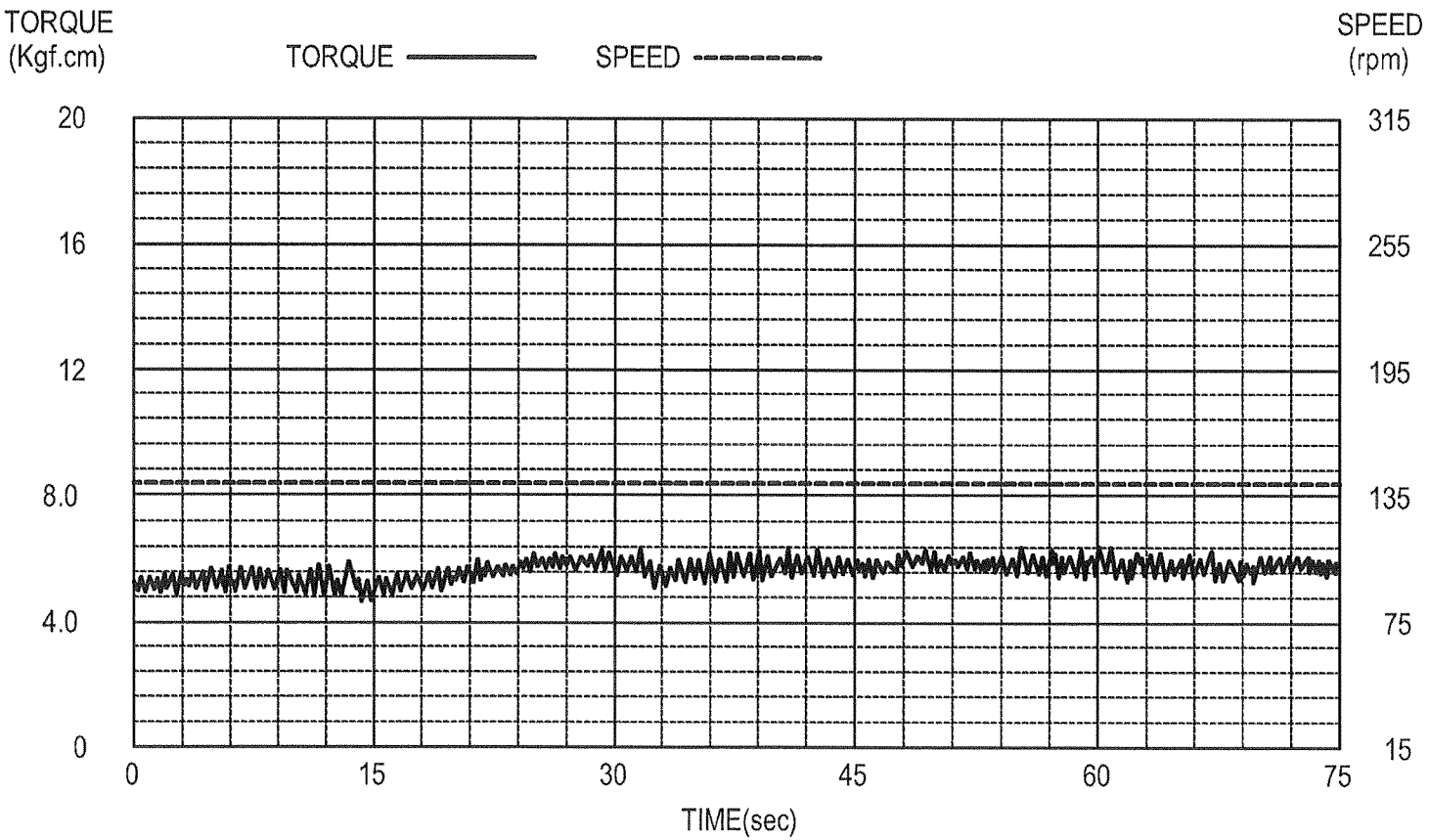
FIG. 8 is a graph illustrating the change over time in the torque and the rotational speed during an initial driving stage of the driving motor of the fusing unit configured as shown in FIGS. 4 to 6.

As shown in FIGS. 4 to 6, in the case that the pressing force is adjusted in the order of the first pressing force P1, the third pressing force P3 and the second pressing force P2, the pressing force is increased along a pressing force curve as shown in FIG. 7, it may be possible to improve the driving torque characteristic of the driving motor 20 as shown in FIG. 8.

FIG. 8 graphically illustrates the change in the torque and in the rotational speed over a duration of time including the initial driving stage of the driving motor of the fusing unit of a configuration, such as, for example, shown in FIGS. 4 to 6.

Referring to FIG. 8, the driving torque of the driving motor at the time when the start of the driving of the fusing unit is maintained substantially at about 5 kgf·cm, which is the same driving torque of the driving motor during the stable driving state. Accordingly, an overloading of the driving motor 20 due to excessive torque during the initial driving stage can be avoided, thereby prolonging the operational life of the motor and/or preventing an out-of-step condition of the driving motor 20.

Figure 9:
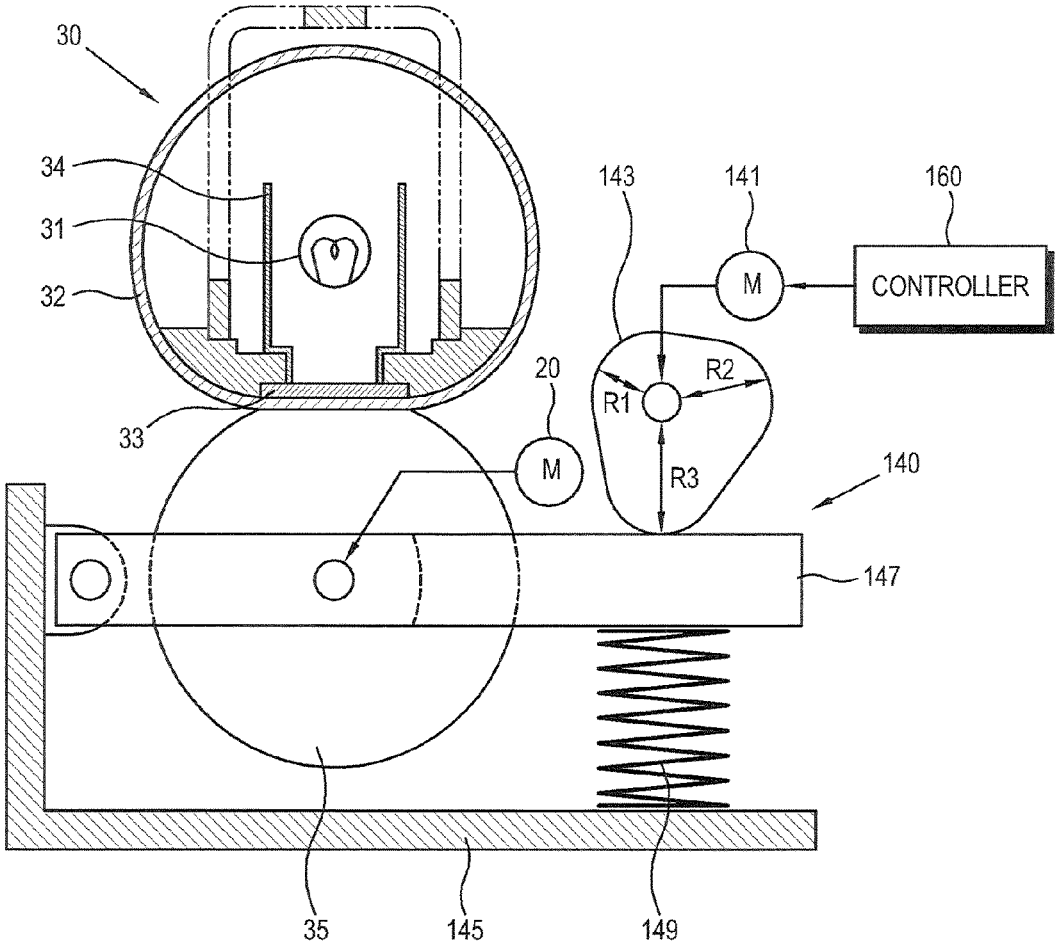
FIG. 9 is a sectional view illustrating a fusing unit according to another embodiment of the present disclosure.

FIG. 9 is a schematic sectional view illustrating a fusing unit according to another embodiment of the present disclosure.

Referring to FIG. 9, the fusing unit according to the embodiment may include a driving motor 20, a fusing part 30, a pressing force adjuster 140 and a controller 160. As the driving motor 20 and the fusing part 30 are substantially the same as those of the fusing unit according to the previously described embodiments, the detailed description thereof will not be repeated.

The pressing force adjuster 140 according to an embodiment may be configured to adjust the pressing force applied to the fusing part 30 in several stages. To that end, the pressing force adjuster 140 may include a variable motor 141, a cam member 143, a lever member 147 and an elastic member 149.

The variable motor 141 under the control of the controller 160 may provide the driving power so as to cause the pressing force to vary. The variable motor 141 may include a stepping motor, for example. According to an embodiment, the pressing force adjuster 140 may include a groove sensor (not shown) for detecting the position of a groove formed in the lever member 147, and, based on the detected position of the groove, may control the number of steps of the variable motor 141 to improve the accuracy of the pressing force adjustments for various operating stages of the fusing unit.

The cam member 143 may be rotated by the variable motor 141, and may have a cam profile for setting at least 2 operational modes. By way of an example, in the embodiment shown in FIG. 9, the cam member profile allows for setting of 3 operational modes based on the radii, i.e., the radial distances from the rotational center of the cam member 143, R1, R2 and R3. According to an embodiment, the radii satisfy the relationship, R1<R2<R3. Each of radii R3, R2 and R1 correspond to the first pressing force P1, the third pressing force P3 and the second pressing force P2, respectively.

The lever member 147 may be rotatably installed to a frame 145, and may support the pressing roller 35 of the fusing part 30. The elastic member 149 may elastically biases the lever member 147 towards the cam member 143, and may apply the first to third pressing forces P1, P2 and P3 to the fusing part 30 according to the operational modes of the cam member 143. To that end, the elastic member 149 may include a compression spring which is disposed between the frame 145 and the lever member 147.

With the above-described configuration, the pressing force adjuster 140 may control the pressing force applied to the fusing part 30 in stages.

Figure 10:
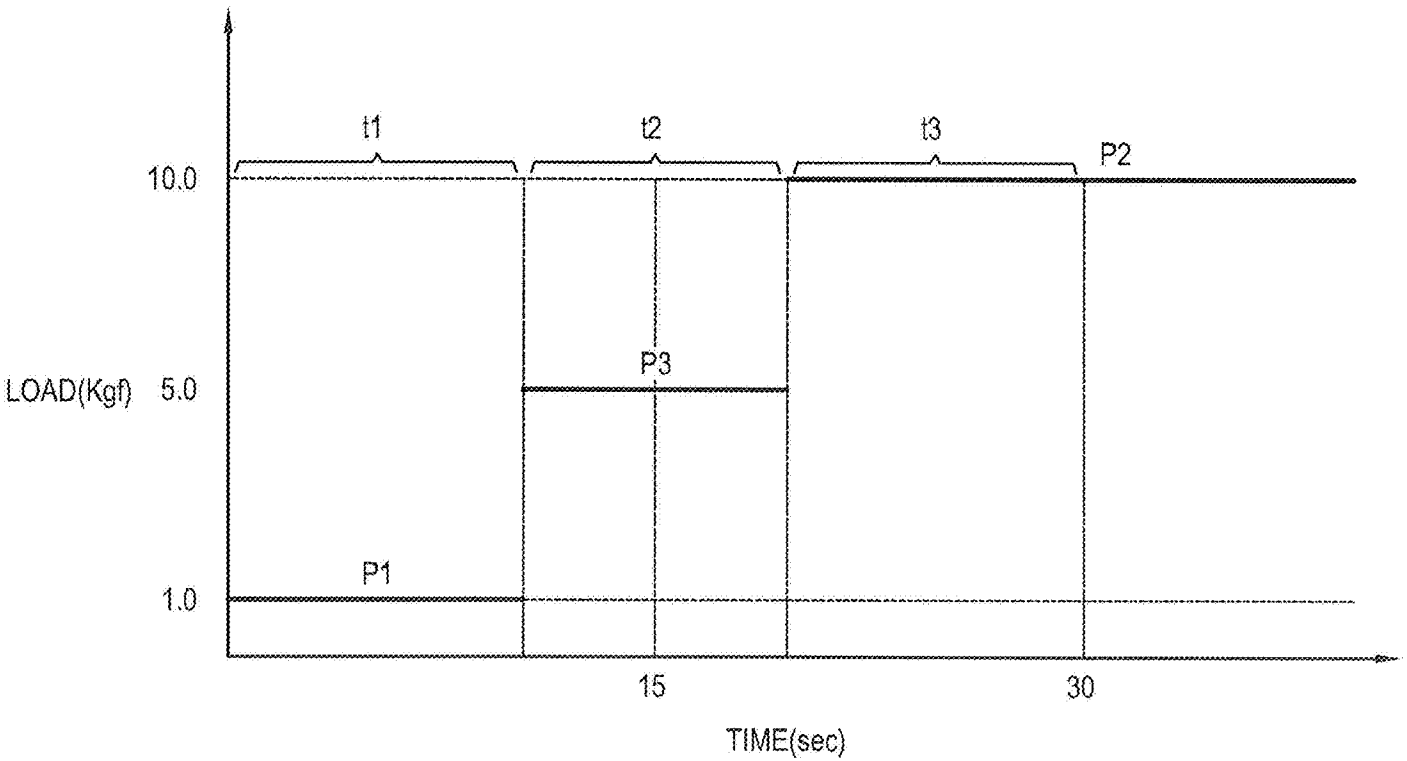
FIG. 10 is a graph illustrating the change over time in the pressing force of the fusing unit of FIG. 9.

The controller 160 may be configured to control the pressing force adjuster 140 so that the pressing force applied to the fusing part 30 can be adjusted according to the driving torque of the driving motor 20. For example, according to an embodiment, and as shown in FIG. 10, the controller 160 controls the pressing force adjuster 140 so that the third pressing force P3 is applied for a duration of time when the pressing force increases from the first pressing force P1 to the second pressing force P2. The third pressing force P3 may be greater than the first pressing force P1, and may be less than the second pressing force P2.

Further, the controller 160 may be configured to control the pressing force adjuster 140 so that the time duration during which the third pressing force P3 is applied is shorter than the time duration for applying the first pressing force P1. Accordingly, the driving torque characteristic of the driving motor 20 can be improved as shown in FIG. 8 by controlling the pressing force adjuster 140.

Hereinafter, a method of controlling a fusing unit according to an embodiment of the present invention will be described with reference to FIGS. 4 to 11.

Figure 11:
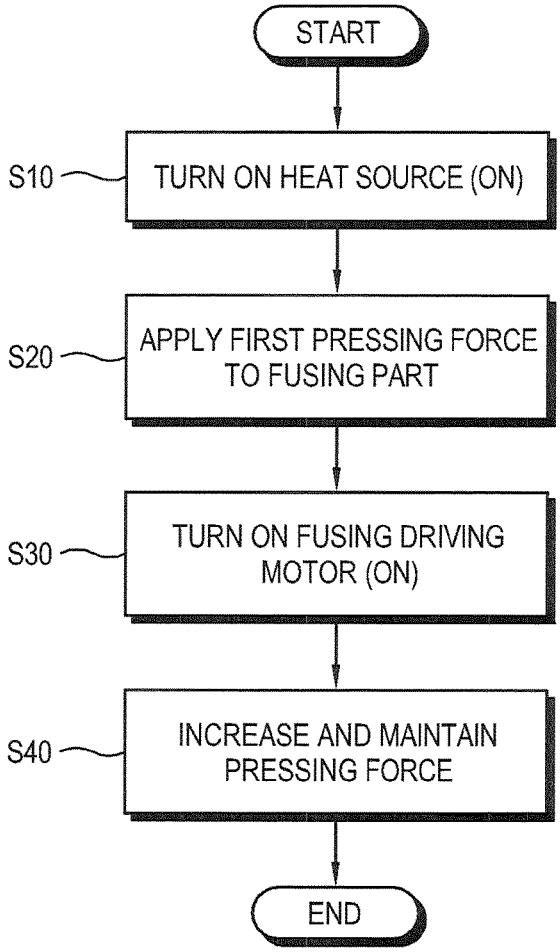
FIG. 11 is a flowchart illustrating a control method of a fusing unit according to an embodiment of the present disclosure.

FIG. 11 is a flowchart illustrating the control method of the fusing unit according to an embodiment.

The control method of the fusing unit according to an embodiment begins its process when a command to start the driving of the fusing unit is received. With respect to an embodiment, an initial driving stage refers to a driving stage that includes a warming up of the fusing unit, such as, for example, upon receipt of a first printing command after the initial powering up of the image forming apparatus.

When the command to start the driving of the fusing unit received, initially, the first pressing force that is less than the second pressing force applied to the fusing part in the normal operational state may be applied to the fusing part (S20). By way of an example, during the process step S20, the pressing force adjuster 40 above described may be in a state shown in FIG. 4. The process step of driving the heat source 31 (S10) may be performed before or after the operation S20.

Then, the driving motor 20 which rotates the fusing part maybe turned on (S30). In this way, the driving motor 20 may be operated in a state that the first pressing force is applied to the pressing roller 35, thereby preventing a rapid increase in the driving torque of the driving motor 20.

Then, the pressing force applied to the fusing part may be adjusted so as to increase to the second pressing force over time (S40).

In operation S40, when the pressing force exerted on the pressing roller 35 increases from the first pressing force P1 to the second pressing force P2, the gear lever 43 operates in the order as shown in FIGS. 4 to 6, thereby gradually increasing the pressing force with a varying rate of increase in different time segments.

In operation S40, when the time duration required for the pressing force to reach the second pressing force P2 is divided into 3 equally spaced time periods, that is, a first to third time periods t1, t2 and t3, the pressing force may be adjusted so that the rate of increase in the pressing force in the second time period t2 is higher than those of the first and the third time periods t1 and t3.

Further, in operation S40, as shown in FIG. 9, the pressing force may be increased in stages. In this case, the cam profile may be formed to realize 3 or more modes so that the pressing force is applied in the order of the first pressing force P1, the third pressing force P3 and then the second pressing force P2. In order to acquire the driving torque graph of the driving motor as shown in FIG. 8, the controller 160 may be configured to control the variable motor 141 so that the time duration during which the third pressing force P3 is applied is shorter than the time for applying the first pressing force P1.

According to the control method of the fusing unit according to the embodiments described above, the pressing force applied to the fusing unit may be adjusted gradually or in stages over time, thereby preventing a rapid increase in the driving torque of the driving motor during the initial driving stage.

Figure 12:
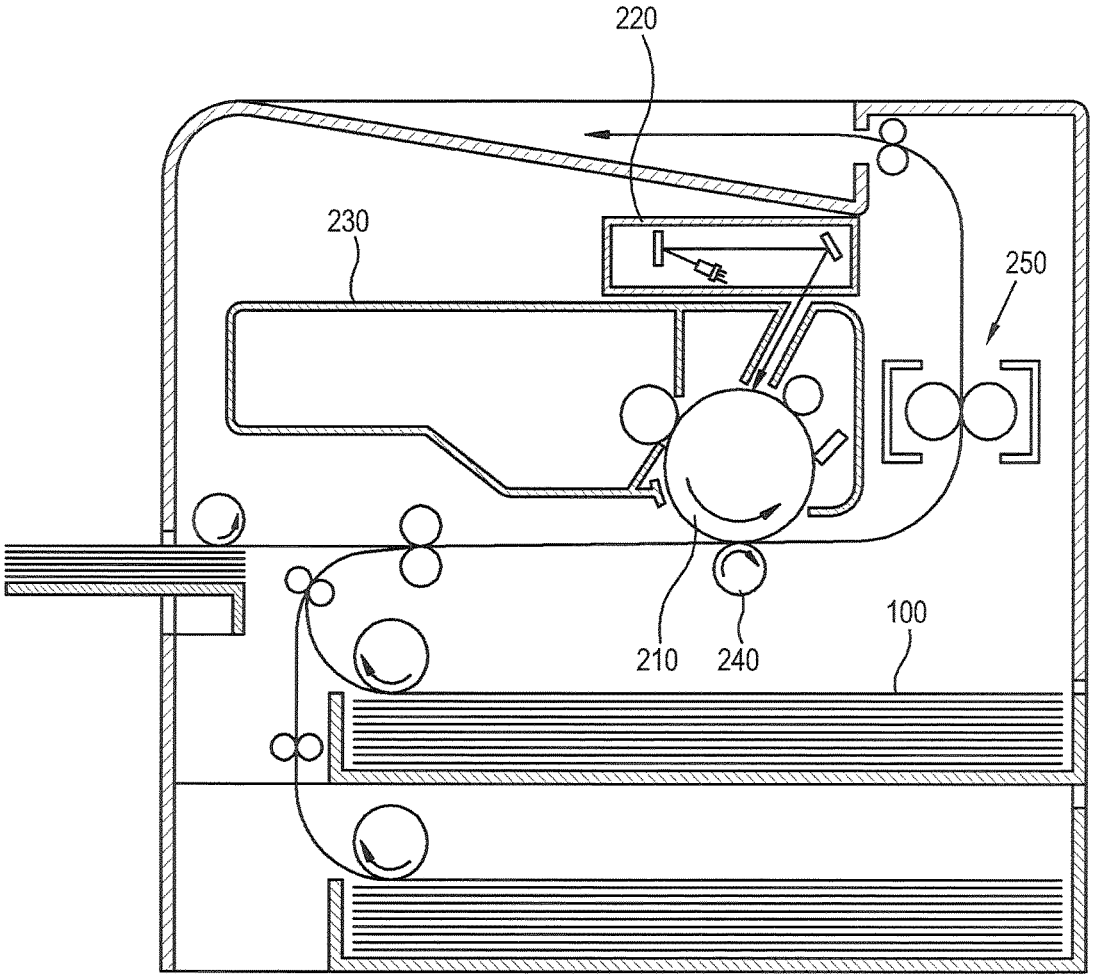
FIG. 12 is a schematic diagram illustrating an image forming apparatus according to an embodiment of the present disclosure.

FIG. 12 is a schematic sectional view illustrating an image forming apparatus according to an embodiment of the present disclosure.

Referring to FIG. 12, an image forming apparatus according to an embodiment may include an image receptor 210, a light exposure unit 220 configured to form an electrostatic latent image on the image receptor 210, a developing unit 230 configured to develop the electrostatic latent image into a visible toner image, a transfer unit 240 and a fusing unit 250.

The transfer unit 240 may be disposed to oppose the image receptor 210 with a printing medium 100 fed along the feed path being interposed therebetween, and transfers the toner image formed on the image receptor 210 by the developing unit 230 onto the supplied printing medium 100.

The fusing unit 250 may include a driving motor, a fusing part, a pressing force adjuster and a controller, and may fuse the toner image on the printing medium 100. To that end, The configuration and operations of the fusing unit 250 may be substantially the same as the fusing unit according to the above-described embodiments of the present disclosure. It should be readily apparent to those skilled in the art that the controllers 60 and 160 described above may be a dedicated controller configured to control the fusing units herein described or may be a main controller that may controls the operations of various components of the image forming apparatus, e.g., one or more of the image receptor 210, the light exposure unit 220, the developing unit 230 and the transfer unit 240 as well as the fusing unit 250, and to control various printing operations of the image forming apparatus, and to implement the various control operations herein described. To that end, according to an embodiment, the controller may be, e.g., a microprocessor, a microcontroller or the like, that includes a CPU to execute one or more computer instructions to implement the various control operations herein described, and may further include a memory device, e.g., a Random Access Memory (RAM), Read-Only-Memory (ROM), a flesh memory, or the like, to store the one or more computer instructions.

According an aspect of the present disclosure, a fusing unit, a control method thereof and an image forming apparatus employing the fusing unit according to embodiments described above may allow the pressing force applied during an initial driving stage of the fusing unit to be small, and to be increased over time, thereby improving the driving torque characteristic of the driving motor of the fusing unit. Accordingly, an excessive load on the driving motor during the initial driving stage may be lessened, resulting in improved reliability and/or operational life of the motor, and/or in reduced occurrences of out-of-step conditions of the driving motor.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A fusing unit, comprising:

a fusing device configured to be rotationally driven by a driving motor and to apply heat and pressure so as to fix an image on a printing medium;

a pressing force adjuster configured to vary a pressing force applied by the fusing device; and a controller configured to control the pressing force adjuster so as to selectively adjust the pressing force applied by the fusing device in consideration of a driving torque of the driving motor, wherein the controller is configured to control the pressing force adjuster so that a first pressing force is applied by the fusing device during an initial driving stage of the fusing device and a second pressing force is applied at a later time than the initial driving stage, the first pressing force being less than the second pressing force that is applied by the fusing device during a normal driving stage of the fusing device, and wherein the controller is configured to control the pressing force adjuster so that a rate of increase in the pressing force varies during a duration of time.

2. The fusing unit according to claim 1, wherein the controller is configured to control the pressing force adjuster so that the pressing force applied by the fusing device continuously increases from the first pressing force to the second pressing force over the duration of time.

3. The fusing unit according to claim 2, wherein the duration of time is divisible into first, second and third sequential time periods of substantially equal duration, the rate of increase in the pressing force being greater during the second sequential time period than that during each of the first and third sequential time periods.

4. The fusing unit according to claim 3, wherein the pressing force adjuster comprises:

a variable motor controlled by the controller; a gear lever configured to be rotationally driven by the variable motor;

a first lever member configured to rotate about a first hinge in engagement with the gear lever;

a second lever member configured to rotate about a second hinge, and to press against a portion of the fusing device; and an elastic member disposed between the first lever member and the second lever member, the elastic member being configured to vary an elastic force applied to the second lever member according to a rotational position of the first lever member.

5. The fusing unit according to claim 1, wherein the controller is configured to control the pressing force adjuster so that the pressing force applied by the fusing device increases from the first pressing force to the second pressing force in a plurality of stages over the duration of time.

6. The fusing unit according to claim 5, wherein the pressing force adjuster comprises:

a variable motor controlled by the controller; a cam member configured to be rotated by the variable motor and having a cam profile that includes at least two different radii;

a lever member configured to pivot about a hinge and supporting a portion of the fusing device; and an elastic member configured to elastically bias the lever member towards the cam member.

7. The fusing unit according to claim 6, wherein the cam profile of the cam member comprises at least three different radii, each of which respectively corresponding to first, second, and third operational stages of the fusing device, the fusing device applying the first pressing force in the first operational stage, a third pressing force in the second operational stage, and the second pressing force in the third operational stage, wherein the third pressing force is greater than the first pressing force and smaller than the second pressing force, and the controller controls the pressing force adjuster so that the second operational stage occurs between the first and the third operational stages.

8. The fusing unit according to claim 7, wherein the controller is configured to control the pressing force adjuster so that a first time duration during which the fusing device is in the second operational stage is shorter than a second time duration during which the fusing device is in the first operational stage.

9. The fusing unit according to claim 1, wherein the fusing device comprises:

a belt member configured to rotate;

a heat source disposed inside the belt member; a nip plate disposed inside the belt member and in pressing contact with a portion of the belt member; and a pressing roller arranged outside the belt member in pressing contact with the belt member so as to oppose the nip plate with the belt member being interposed therebetween to thereby form a contact nip between the belt member and the pressing roller.

10. A method of controlling a fusing unit configured to apply heat and pressing force to fix an image onto a printing medium, comprising:

applying a first pressing force in the fusing unit at a first time corresponding to an initial driving stage of the fusing unit;

operating a driving motor to rotate at least a portion of the fusing unit; and adjusting the pressing force such that a second pressing force greater than the first pressing force is applied in the fusing unit at a second time later in time than the first time, wherein the first pressing force being less than the second pressing force that is applied by the fusing device during a normal driving stage of the fusing device, and wherein a rate of increase in the pressing force is variable during a duration of time between the first and second times.

11. The method according to claim 10, wherein the step of adjusting the pressing force comprises: continuously increasing the pressing force from the first pressing force to the second pressing force.

12. The method according to claim 11, wherein the duration of time is divisible into first, second and third sequential time periods of substantially equal duration, the rate of increase in the pressing force being greater during the second sequential time period than that during each of the first and third sequential time periods.

13. The method according to claim 10, wherein the step of adjusting the pressing force comprises:

increasing the pressing force in stages that includes a stage in which a third pressing force that is greater than the first pressing force and that is smaller than the second pressing force is applied for a predetermined period of time between stages of application of the first pressing force and the second pressing force.

14. The method according to claim 13, wherein the predetermined time during which the third pressing force is applied is shorter than a time duration during which the first pressing force is applied.

15. An image forming apparatus, comprising:

an image receptor;

a light exposure unit configured to expose the image receptor to thereby form thereon an electrostatic latent image;

a developing unit configured to develop the electrostatic latent image to thereby form a toner image on the image receptor;

a transfer unit configured to cause the toner image formed on the image receptor to be transferred onto a printing medium;

a controller; and a fusing unit configured to fix the transferred toner image on the printing medium, the fusing unit comprising:

a fusing device configured to the rotationally driven by a driving motor and to apply heat and pressing force to the printing medium so as to fix the toner image on the printing medium; and a pressing force adjuster configured to vary the pressing force applied by the fusing device, wherein the controller is configured to control the pressing force adjuster so as to selectively adjust the pressing force applied by the fusing device in consideration of a driving torque of the driving motor, and wherein the controller is configured to control the pressing force adjuster so that a first pressing force is applied by the fusing device during an initial driving stage of the fusing device and a second pressing force is applied at a later time than the initial driving stage, the first pressing force being less than the second pressing force that is applied by the fusing device during a normal driving stage of the fusing device, and wherein the controller is configured to control the pressing force adjuster so that a rate of increase in the pressing force varies during a duration of time.

16. The image forming apparatus according to claim 15, wherein the controller is configured to control the pressing force adjuster so that the pressing force applied by the fusing device continuously increases from the first pressing force to the second pressing force over the duration of time.

17. The image forming apparatus according to claim 16, wherein the duration of time is divisible into first, second and third sequential time periods of substantially equal duration, the rate of increase in the pressing force being greater during the second sequential time period than that during each of the first and third sequential time periods.

18. The image forming apparatus according to claim 15, wherein the controller is configured to control the pressing force adjuster so that the pressing force applied by the fusing device increases from the first pressing force to the second pressing force in a plurality of stages over a duration of time.

* * * * *